US005568832A

United States Patent [19]

Eddy

[11] Patent Number: 5,568,832

[45] Date of Patent: Oct. 29, 1996

[54] SKYLIGHT SHADE

[76] Inventor: Zonell Eddy, 5138 Ashdown Pl., Midland, Tex. 79705

[21] Appl. No.: 325,032

[22] Filed: Oct. 18, 1994

[51] Int. Cl.[6] ..... E06B 9/24

[52] U.S. Cl. ..... 160/374; 160/376; 160/369

[58] Field of Search ..... 160/335, 333, 160/336, 374, 372, 368.1, 369, 371, 373, 376, 377, 378; 5/627

[56] References Cited

U.S. PATENT DOCUMENTS

| | | | |
|---|---|---|---|
| 450,792 | 4/1891 | Dodd | 160/376 |
| 548,488 | 10/1895 | Way | 160/376 |
| 1,396,208 | 11/1921 | Hubbard | 5/627 |
| 2,600,192 | 6/1952 | Bell | 160/372 |
| 3,097,014 | 7/1963 | Francis | 160/374 X |
| 3,924,671 | 12/1975 | Gates . | |
| 4,328,853 | 5/1982 | Gall et al. . | |
| 4,557,310 | 12/1985 | Ames et al. . | |
| 4,762,160 | 8/1988 | Bechtold et al. . | |
| 4,883,109 | 11/1989 | Sonderby . | |
| 5,088,543 | 2/1992 | Bilbrey . | |
| 5,204,777 | 4/1993 | Curshod . | |
| 5,384,926 | 1/1995 | Al-Bargi | 5/627 |

*Primary Examiner*—Blair Johnson
*Attorney, Agent, or Firm*—Chase & Yakimo

[57] ABSTRACT

A skylight shade formed of a frame and engageable with the sides of a skylight opening and a filter sheet supported by the frame. The frame is formed from a plurality of adjustable rods which each have an outer member and an inner member which is adjustably received within the outer member and engages a spring therein. The outer member has a aperture extending perpendicularly therethrough adjacent one end and receives an end of an inner member of another rod therein. The filter sheet has attachment sleeves which are received around the rods for attaching the filter sheet to the frame. The rods contract via springs to allow each rod to be received within the skylight opening and are forcibly biased via springs the rod into secure engagement with the sided of the skylight opening.

9 Claims, 4 Drawing Sheets

SKYLIGHT SHADE

FIELD OF THE INVENTION

The invention relates to a skylight shade. Specifically, the shade allows light to pass through the skylight but reflects up to eighty percent of the solar radiation passing through the skylight, thereby reducing the heat gain within the skylight's interior room.

BACKGROUND OF THE INVENTION

Skylights are commonly installed, especially in residential construction, since they provide a source of natural overhead lighting. However, the solar radiation passing through skylights can result in a tremendous heat gain within the interior room beneath the skylight. Although several types of blinds or shades have been designed specifically for use with skylights, they have disadvantages. While they may reduce heat gain, they also block essentially all of the sun light from passing through the skylight. Moreover, they may be very expensive, typically have many parts and can be difficult to assemble and install. Thus, a need exists for a new skylight shade.

SUMMARY OF THE INVENTION

Accordingly, a primary object of the subject invention is to provide a skylight shade having a frame securable to the sides of the skylight formed from a plurality of adjustable rods and a filter sheet that extends continuously between the rods and is supported by the frame.

Another object of the subject invention is to provide a skylight shade that allows light to pass through the skylight but reflects the solar radiation passing through the skylight, thereby reducing the heat gained through the skylight.

A further object of the subject invention is to provide a skylight shade that is easy to assemble and install.

Yet a further object of the subject invention is to provide a skylight shade that is inexpensive and easy to manufacture.

Still a further object of the subject invention is to provide a skylight shade that is simple and has only a few parts.

The foregoing objects are basically attained by providing a skylight shade having a frame securable to the sides of a skylight opening. The frame is formed from a plurality of adjustable rods which each have an outer member and an inner member. Each inner member is adjustably received within an outer member and engages a spring therein. Each outer member also has an aperture extending perpendicularly therethrough at the end opposite its corresponding inner member. Each spring contracts to allow each rod to be received within the skylight opening and then, forcibly biases the rod into secure engagement with the sides of the skylight opening. A filter sheet extends continuously between the rods and includes attachment sleeves which are received around the rods for attaching the filter sheet to the frame. The filter sheet is preferably formed from a reflective cloth material which allows light to pass therethrough but reflects the sun's heat rays.

Other objects, advantages and salient features of the invention will become apparent from the following detailed description, which, taken in connection with the annexed drawings, discloses the invention.

DETAILED DESCRIPTION

Figure 1:
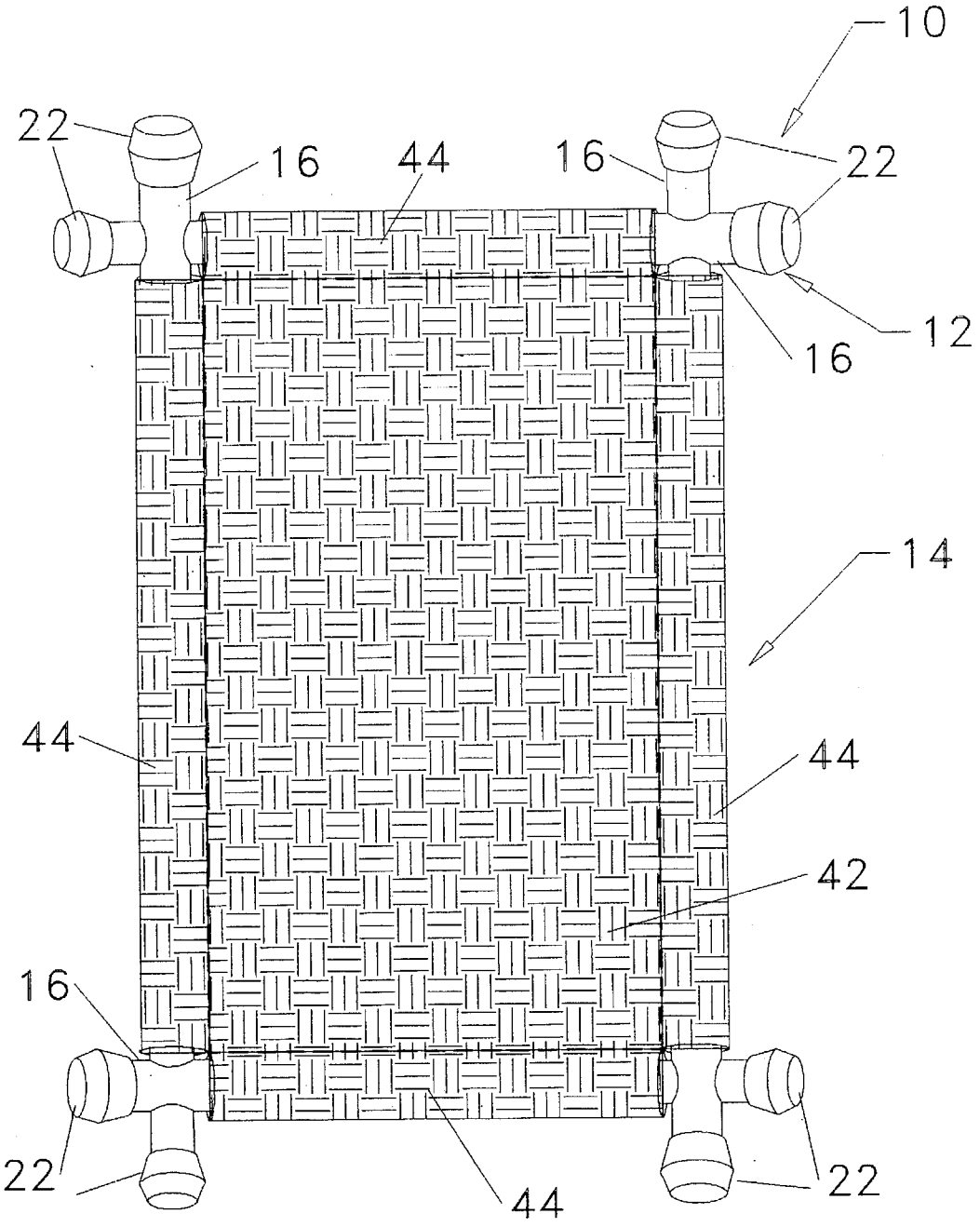
FIG. 1 is a bottom view of a skylight shade in accordance with the present invention.

A skylight shade 10, as seen in FIG. 1, is formed from an adjustable frame 12 which supports a filter sheet 14. The shade 10 is securable within the skylight's opening and allows light to pass through the skylight but reflects up to eighty percent of the solar radiation which passes through the skylight. The shade 10 thereby reduces the heat gain to the skylight's interior without eliminating the natural overhead lighting provided by the skylight.

Figure 2:
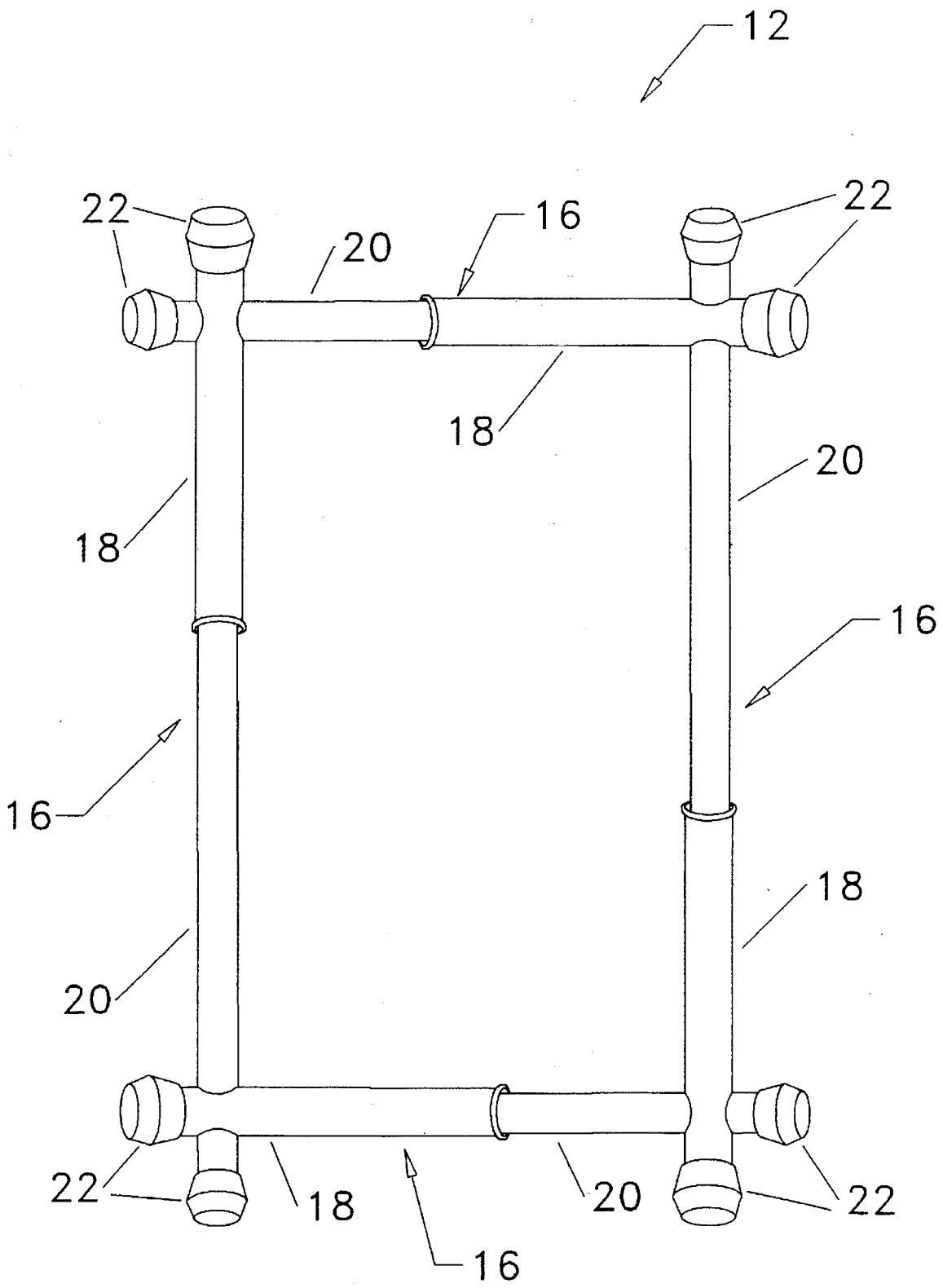
FIG. 2 is a bottom view of the filter sheet of the skylight shade of FIG. 1.
Figure 4:
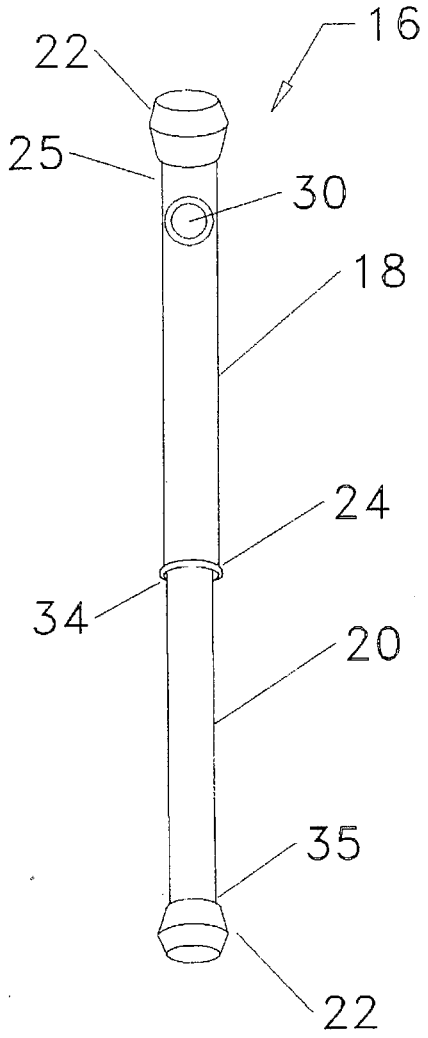
FIG. 4 is a side view of one rod used to form the frame of FIG. 3.

As seen in FIGS. 1 and 2, frame 12 fits within a rectangular skylight opening. Frame 12 can be modified to fit within a skylight opening having any shape, however. Frame 12 is formed from rods 16. Each rod 16 is identical and thus, only one rod will be discussed in detail. It should be understood that the same features apply to each rod 16. Rod 16, as seen in FIG. 4, is formed of metal and includes an outer member 18, inner member 20 and end caps 22.

Figure 5:
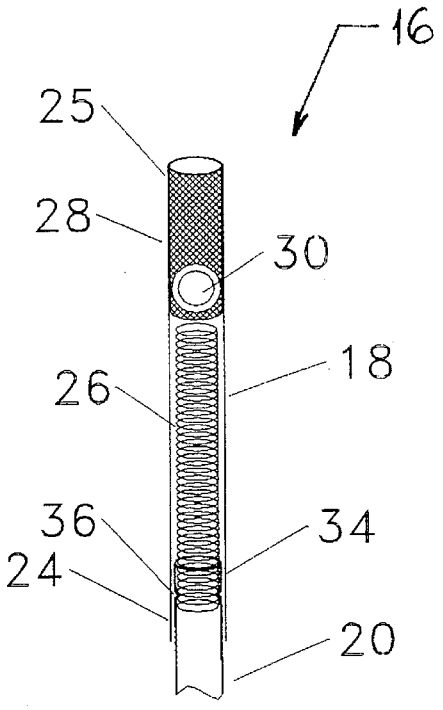
FIG. 5 is a partial and broken away view of the rod of FIG. 4 showing the biasing member and the reinforcement cylinder of the rod with its end cap removed.

Outer member 18 includes biasing member 26 inserted through the first end 24 of outer member 18 and reinforcement cylinder 28 at the second end 25 of outer member 18, as seen in FIG. 5. Biasing member 26 is preferably a coiled spring, which at one end engages reinforcement cylinder 28 and at its other end is coupled to inner member 20. The reinforcement cylinder 28 has an aperture 30 which extends perpendicularly therethrough adjacent the second end 25 of outer member 18. Aperture 30 has a diameter greater than the diameter of inner member 20. Outer member 18 is hollow or tube-like except at reinforcement cylinder 28 where it is preferably solid throughout its diameter.

First end 34 of inner member 20 is slidably and adjustably received within the first end 24 of outer member 18, as seen in FIG. 5. Thus, inner member 20 has a smaller diameter than outer member 18. Inner member 20 includes collar 36 which is formed adjacent the inner member's first end 34 and extends into the interior of inner member 20. One end of biasing member 26 is coupled to inner member 20 at collar 36. Inner member is hollow or tube-like.

End caps 22 are formed of rubber and fit snugly on the second ends 25 and 35 of outer and inner members 18 and 20, respectively. End caps 22 protect the skylight opening surfaces from being scraped.

Figure 3:
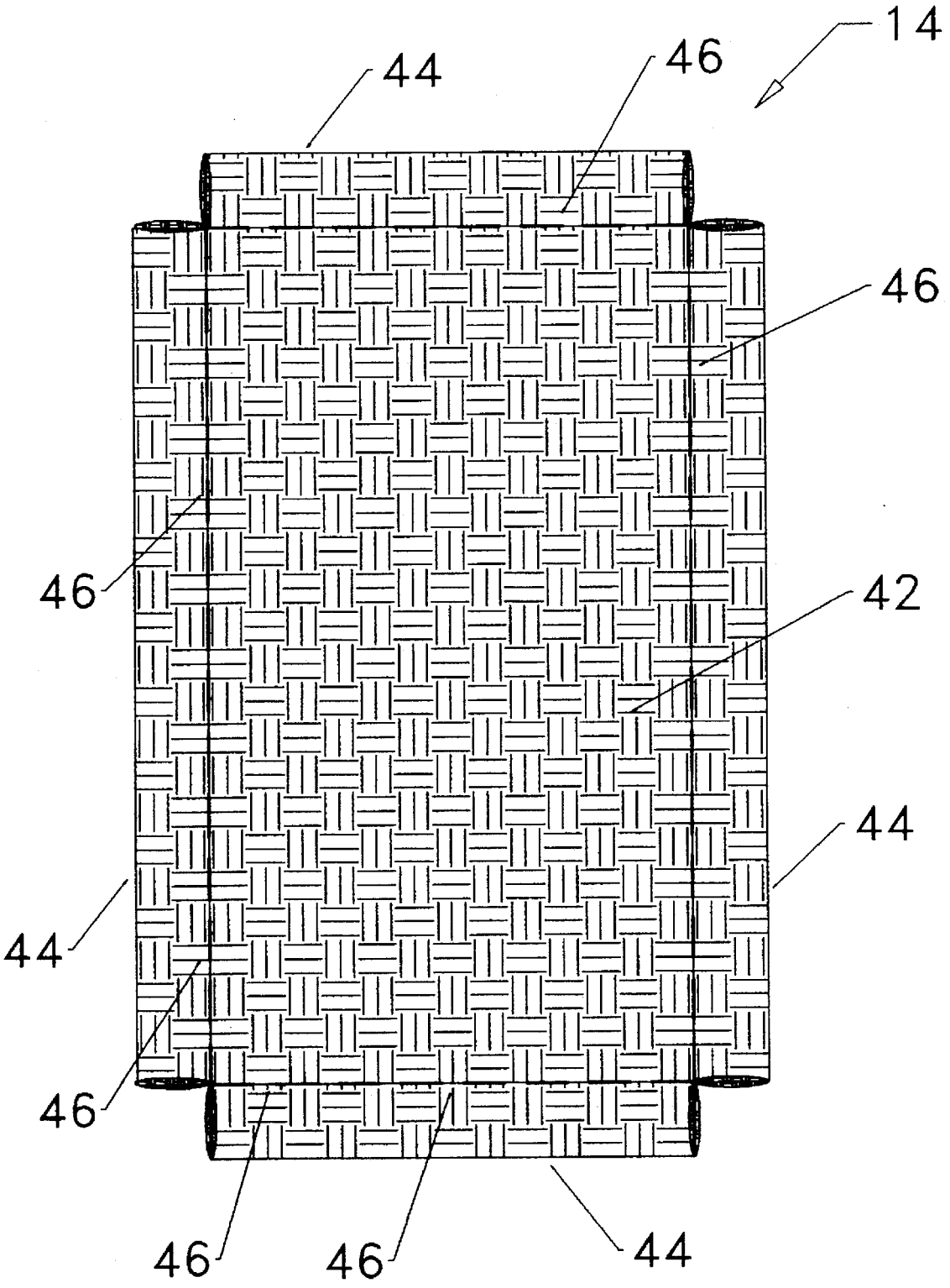
FIG. 3 is a bottom view of the frame of the skylight shade of FIG. 1.

Filter sheet or panel 12 is preferably composed of a white reflective material which reflects the sun's heat producing rays, such as a tightly woven panel of polyester. Thus, when the heat rays pass through the skylight, up to eighty percent of the solar radiation is reflected from the filter sheet 14 which greatly reduces the heat gain through the skylight. Filter sheet 14 includes a main body 42 and attachment sleeves 44. As in FIG. 3, main body 42 is rectangular to correspond to the shape of the skylight, however, the shape of the main body 42 may be modified to correspond to differently shaped skylights. Attachment sleeves 44 are formed by doubling the cloth of filter sheet 14 over and securing the cloth to the main body 42, which is preferably done by stitching 46. Attachment sleeves 44 must be large enough to fit around rods 16, and the number of attachment sleeves 44 corresponds to the number of rods 16.

Assembly and Operation

The frame 12 is assembled to correspond to the shape of the skylight. When the skylight is rectangular, four rods 16 are used, as seen in FIG. 1. Spring 26 within each rod 16 is coupled at one end to the collar 36 of inner member 20. The other end of each spring 26 and the first end 34 of each inner member 20 are then inserted within the first end 24 of their corresponding outer member 18 so that springs 26 each engage a reinforcement cylinder 28.

The sides of filter sheet 14 are folded over and stitched to the main body 42 to form the attachment sleeves 44, as seen in FIG. 2. A rod 16 is then inserted through each attachment sleeve 44 with the second end 35 of each inner member 20 extending through the aperture 30 in the outer member 18 of the adjacent rod 16. As in FIGS. 1 and 2, apertures 30 extend perpendicularly through each rod 16 so that 90° corners are formed between rods 16 and a rectangular shape is achieved. Apertures 30 can be at different angles to achieve a differently shaped frame 12. End caps 22 are placed over both ends of each rod 16, as seen in FIG. 1.

In operation, pressure is exerted on the ends of the rods 16 which biases springs 26 inwardly since they are coupled to inner members 20 at one end and engage reinforcement cylinder 28 at their other end. Each rod 16 is thereby shortened so that skylight shade 10 can be inserted into the sides of the skylight. Upon removing the pressure from the rods 16, each spring 26 therein forces each rod 16 outwardly into secure engagement with the sides of the skylight. Since the end caps 22 are rubber, they prevent the ends of rods 16 from scraping the sides of the skylight. Once inserted and securely engaged against the sides of a skylight, filter sheet 14 allows light to pass through the skylight and into the interior room but reflects up to eighty percent of the sun's heat rays thereby greatly decreasing the heat gain within the interior room.

While the most advantageous embodiment has been chosen to illustrate the invention, those skilled in the art should understand that various changes and modifications can be made therein without departing from the scope of the invention as defined in the appended claims and the equivalents thereof.

Having thus described the invention, what is claimed as new and desired to be secured by Letters Patent is as follows:

1. A shade for engagement with sides of a skylight opening or similar opening for emitting daylight therethrough, comprising:

a frame engageable with the sides of the opening, said frame comprising:

a plurality of four rods, each of said rods having first and second ends;

means for adjusting a length of each of said rods whereupon each of said rods spans one of the sides of the opening with said rod ends engaging opposed sides of the opening;

means for coupling a first end of one of said rods with a second end of another of said rods, said means comprising an aperture in said second end of each of said rods for normal extension of said first end of one of said other rods therethrough, whereupon said coupled rods define said frame, the sides of the opening bounding said frame;

a sheet extending between said rods and being supported by said frame for filtering the daylight passing through said opening.

2. A skylight shade as claimed in claim 1, wherein each said rod includes a first inner member including said first rod end and a second outer member including said aperture into which said first rod end of said inner member of another rod adjustably extends.

3. A skylight shade as claimed in claim 2, wherein said adjusting means includes a biasing member within each said rod's second outer member, each said first inner member engaging its rod's said biasing member, each said biasing member contracting to allow its said rod to be received within the opening and forcibly biasing its said rod into first and second ends, said engagement with sides of the opening.

4. A skylight shade as claimed in claim 3, wherein said bias member is a coiled spring.

5. A skylight shade as claimed in claim 1, wherein said filter sheet includes attachment sleeves received around said rods for attaching said filter sheet to said frame.

6. A skylight shade as claimed in claim 1, wherein said filter sheet is formed of reflective cloth material.

7. A skylight opening shade, comprising:

a frame engageable with sides of the skylight opening formed from a plurality of adjustable rods, each said rod having a first outer member and a second inner member, one end of said inner member being adjustably received within a first open end of said first outer member; and a filter sheet extending between said rods and including attachment sleeves received around said rods for attaching said filter sheet to said frame, each said first outer members having an aperture extending perpendicularly therethrough, each said aperture being adjacent a second end of its said first outer member for receiving a second end of an inner member of another of said rods therethrough, each of said rods having a biasing member within its said first outer member for engagement with its said second inner member, each said biasing member contracting to allow its said rod to be received within the skylight opening and forcibly biasing its said rod into secure engagement with sides of the skylight opening.

8. A skylight shade as claimed in claim 7, wherein said frame includes four said rods.

9. A skylight shade as claimed in claim 7, wherein said filter sheet is formed of reflective cloth material.

* * * * *